US012203197B2

(12) United States Patent
Rose et al.

(10) Patent No.: US 12,203,197 B2
(45) Date of Patent: Jan. 21, 2025

(54) KNIT COMPONENT WITH DIFFERING VISUAL EFFECTS

(71) Applicant: NIKE, Inc., Beaverton, OR (US)

(72) Inventors: Payton Rose, Washougal, WA (US); Joseph Zack, Beaverton, OR (US); Yang Chung-Chun, New Taipei (TW); Yung Huang Pan, New Taipei (TW)

(73) Assignee: NIKE, Inc., Beaverton, OR (US)

( * ) Notice: Subject to any disclaimer, the term of this patent is extended or adjusted under 35 U.S.C. 154(b) by 90 days.

(21) Appl. No.: 18/101,687

(22) Filed: Jan. 26, 2023

(65) Prior Publication Data

US 2023/0175174 A1 Jun. 8, 2023

Related U.S. Application Data

(62) Division of application No. 16/816,574, filed on Mar. 12, 2020, now Pat. No. 11,566,353.

(60) Provisional application No. 62/829,977, filed on Apr. 5, 2019.

(51) Int. Cl.

| | |
|---|---|
| ***D04B 1/12*** | (2006.01) |
| ***D04B 1/16*** | (2006.01) |
| ***D04B 1/22*** | (2006.01) |
| ***D04B 21/08*** | (2006.01) |
| ***D04B 21/20*** | (2006.01) |

(52) U.S. Cl.

CPC ..... *D04B 1/126* (2013.01); *D04B 1/16* (2013.01); *D04B 1/22* (2013.01); *D04B 21/08* (2013.01); *D04B 21/20* (2013.01); *D10B 2331/02* (2013.01); *D10B 2331/04* (2013.01); *D10B 2501/04* (2013.01)

(58) Field of Classification Search

CPC . D04B 1/126; D04B 1/16; D04B 1/22; D04B 21/20; D04B 21/08

See application file for complete search history.

(56) References Cited

U.S. PATENT DOCUMENTS

| | | | |
|---|---|---|---|
| 951,033 | A | 3/1910 | Steber |
| 1,599,910 | A | 9/1926 | Mijer |
| 3,828,585 | A | 8/1974 | Thorneburg |

(Continued)

FOREIGN PATENT DOCUMENTS

| | | | |
|---|---|---|---|
| AT | 8414 | U1 | 7/2006 |
| CN | 1495307 | A | 5/2004 |

(Continued)

OTHER PUBLICATIONS

#20 Lenticular Print, Tycoon, QTY 144-576(A), Available online at: <https://ttycoon.com/add-ons/20-lenticular-print/>, Accessed on Aug. 14, 2018, 7 pages.

(Continued)

*Primary Examiner* — Danny Worrell

(74) *Attorney, Agent, or Firm* — Shook, Hardy & Bacon L.L.P.

(57) ABSTRACT

Aspects herein provide for a knit component having a tubular rib knit structure that extends away from a base portion of the knit component. The tubular rib knit structure includes at least a first portion extending along a longitudinal side of the tubular rib knit structure, where the first portion exhibits a first visual effect at a first area of the knit component and exhibits a second visual effect at a second area of the knit component.

20 Claims, 7 Drawing Sheets

(56) References Cited

U.S. PATENT DOCUMENTS

| | | | | |
|---|---|---|---|---|
| 3,958,287 | A | 5/1976 | Okaniwa et al. | |
| 4,000,342 | A | 12/1976 | Rochelle et al. | |
| 4,386,935 | A | 6/1983 | Buehler et al. | |
| 4,420,308 | A | 12/1983 | Buehler et al. | |
| 4,587,153 | A | 5/1986 | Sella | |
| 4,661,116 | A | 4/1987 | Barwick et al. | |
| 4,877,413 | A | 10/1989 | Sire et al. | |
| 4,891,958 | A | 1/1990 | Cournoyer et al. | |
| 4,913,705 | A | 4/1990 | Schlick et al. | |
| 4,944,572 | A | 7/1990 | Young | |
| 5,487,936 | A | 1/1996 | Collier | |
| 5,560,401 | A | 10/1996 | Miglus | |
| 5,741,590 | A | 4/1998 | Kobsa et al. | |
| 6,006,550 | A | 12/1999 | Singh | |
| 6,164,095 | A | 12/2000 | Rock et al. | |
| 7,575,027 | B2 | 8/2009 | Huang | |
| 8,076,253 | B2 | 12/2011 | Sakai et al. | |
| 8,550,124 | B2 | 10/2013 | Tsai | |
| 9,078,488 | B1 | 7/2015 | Meir et al. | |
| D804,797 | S | 12/2017 | Small et al. | |
| 9,971,070 | B2 | 5/2018 | Liles et al. | |
| 11,566,353 | B2 * | 1/2023 | Rose | D04B 21/20 |
| 2002/0138920 | A1 | 10/2002 | Pepitone | |
| 2003/0220037 | A1 | 11/2003 | Dewhurst et al. | |
| 2006/0246802 | A1 | 11/2006 | Hughes et al. | |
| 2016/0108566 | A1 | 4/2016 | Tseng et al. | |
| 2016/0362824 | A1 | 12/2016 | Ausen et al. | |
| 2017/0238644 | A1 | 8/2017 | Meir et al. | |
| 2018/0120597 | A1 | 5/2018 | Lussier | |
| 2018/0163328 | A1 | 6/2018 | Hoffeins et al. | |
| 2018/0179676 | A1 | 6/2018 | Takahashi et al. | |
| 2020/0318266 | A1 | 10/2020 | Rose et al. | |

FOREIGN PATENT DOCUMENTS

| | | | |
|---|---|---|---|
| CN | 204763686 | U | 11/2015 |
| CN | 106835466 | A | 6/2017 |
| CN | 106637578 | B | 7/2018 |
| CN | 110612368 | A | 12/2019 |
| DE | 202010008224 | U1 | 11/2010 |
| EP | 0226048 | A2 | 6/1987 |
| JP | 06-101178 | A | 4/1994 |
| JP | 3164287 | B2 | 5/2001 |
| JP | 3990546 | B2 | 10/2007 |
| JP | 5921871 | B2 | 5/2016 |
| KR | 101458293 | B1 | 11/2014 |
| WO | 2006127648 | A2 | 11/2006 |
| WO | 2008043209 | A1 | 4/2008 |
| WO | 2016/053805 | A1 | 4/2016 |
| WO | 2016/053808 | A1 | 4/2016 |
| WO | 2017209140 | A1 | 12/2017 |
| WO | 2018014476 | A1 | 1/2018 |
| WO | 2018066463 | A1 | 4/2018 |
| WO | 2018123532 | A1 | 7/2018 |

OTHER PUBLICATIONS

FAQs, ColorZen, Available online at: <colorzen.com>, 2018, 3 pages.

For Running and Life-style Shoes New Fabric Developed that Combines Unique Visual Effects and Comfortable Fit, Asics, Available online at: <https://corp.asics.com/en/press/article/2016-06-16-1>, Jun. 16, 2016, pp. 1-3.

Lenticular T-shirt With Custom Design, Chevrolet Writing and Symbol, Red to Gold, Color Changing, Lantor Ltd., Available online at: <https://www.lenticularpromo.com/Lenticular-T-Shirt-Custom-Design-Chevy-Sample-p/ts01-custom.htm>, Accessed on May 11, 2020, pp. 1-3.

Joshi, H.D. , "Dyeing of Nylon, Polyester With Modifications", The Indian Textile Journal, Available online at: <https://indiantextilejournal.com/articles/FAdetails.asp?id=1550>, Oct. 2008, pp. 1-12.

Reiterer, Selina, "Holographic Fabric", Selina Reiterer Textile Design Research, Available online at: < http://www.selinareiterer.com/index.php/holographic-fabric/>, Accessed on Aug. 4, 2016, 5 pages.

Winters, Lon, "Lenticular Garment Graphics—Printing in another Dimension", The M&R Blog, Textile Printing Techniques, Available online at: <https://www.mrprint.com/blog/846-lenticular-garment-graphics-printing-in-another-dimension>, Feb. 26, 2008, pp. 1-5.

Intention to Grant received for European Patent Application No. 20721850.4, mailed on Mar. 16, 2023, 7 pages.

Partial European Search Report and Search Opinion received for European Application No. 23193342.5, mailed on Dec. 11, 2023, 8 pages.

Extended European Search Report and Search Opinion received for European Application No. 23193342.5, mailed on May 7, 2024, 17 pages.

* cited by examiner

KNIT COMPONENT WITH DIFFERING VISUAL EFFECTS

CROSS-REFERENCE TO RELATED APPLICATIONS

This application, entitled "Knit Component with Differing Visual Effects," is a divisional application of co-pending U.S. application Ser. No. 16/816,574, filed Mar. 12, 2020, which claims the benefit of priority of U.S. Prov. App. No. 62/829,977, entitled "Knit Component with Differing Visual Effects," and filed on Apr. 5, 2019. The entirety of the aforementioned application is incorporated by reference herein.

TECHNICAL FIELD

Aspects herein relate to a knit component having a tubular rib knit structure that exhibits differing visual effects at different areas of the knit component.

BACKGROUND

Textiles generally present the same visual appearance when viewed from different viewing angles.

DESCRIPTION OF THE DRAWINGS

Examples of aspects herein are described in detail below with reference to the attached drawing figures, wherein.

DETAILED DESCRIPTION

Figure 1:
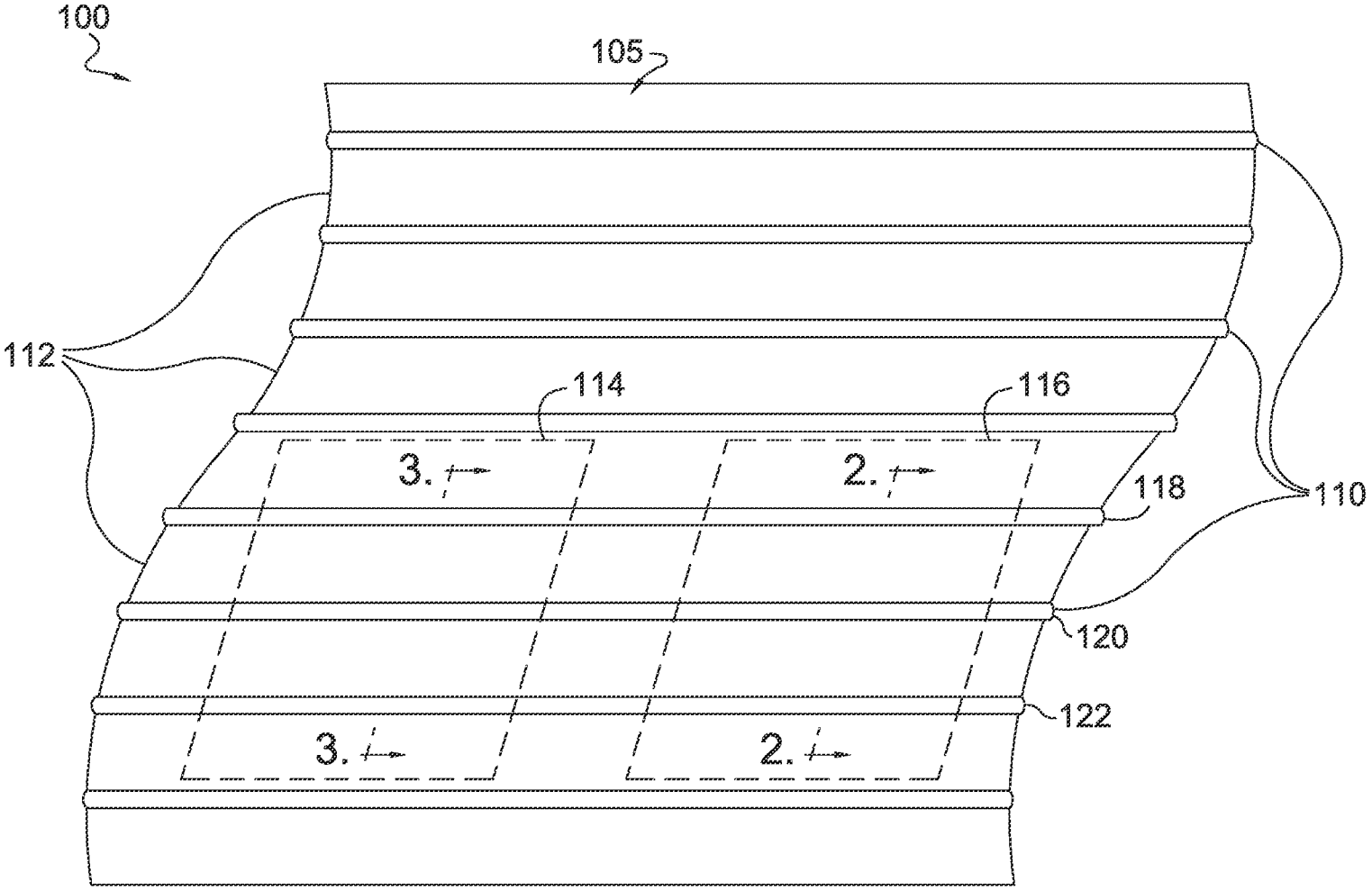
FIG. 1 illustrates a view of an example knit component having tubular rib knit structures that extend through a first area and a second area of the knit component in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

At a high level, aspects herein are directed to a knit component having one or more tubular rib knit structures. The tubular rib knit structure comprises at least a first portion formed from a first yarn and a second portion formed from a second yarn where the first portion and the second portion are positioned on opposing longitudinal sides of the tubular rib knit structure. The tubular rib knit structure may also comprise a third portion formed from a third yarn where the third portion is positioned on a top/upper side of the tubular rib knit structure between the first portion and the second portion. In example aspects, the tubular rib knit structure extends through a first area and a second area of the knit component. The first portion of the tubular rib knit structure exhibits a first visual effect at the first area of the knit component. And the first portion of the tubular rib knit structure exhibits a second visual effect at the second area of the knit component.

In further aspects, the second portion of the tubular rib knit structure exhibits a third visual effect at the first area of the knit component. And, optionally, the second portion of the tubular rib knit structure exhibits a fourth visual effect at the second area of the knit component. In still further aspects, the third portion of the tubular rib knit structure exhibits a fifth visual effect at both the first area and the second area of the knit component.

As will be explained further below, in one aspect, the different visual effects may comprise different colors. Thus, for instance, the first portion of the tubular rib knit structure may exhibit a first color in the first area of the knit component and a different second color in the second area of the knit component. As well, the second portion of the tubular rib knit structure may exhibit a third color in the first area of the knit component and a different fourth color in the second area of the knit component, where the third and fourth colors may be the same as or different from the first and second colors. The third portion of the tubular rib knit structure may exhibit a fifth color in both the first and second areas of the knit component, where the fifth color may be the same as or different from the first, second, third, and fourth colors. The result of the construction described above is a knit component that has color-changing or color-shifting properties between different areas of the knit component. This provides an interesting visual aesthetic that may prove useful when the knit component is incorporated into an article of apparel that is worn by, for instance, an athlete during an athletic competition. In this example, the color-shifting properties of the knit component may produce a level of distraction in other competitors viewing the article of apparel which may provide a competitive edge to the athlete.

The yarns used to knit the knit component are selected to not only produce the color-shifting properties described above but also to maintain the color integrity of the knit component during wash and wear. In example aspects, the yarn used to knit the first portion of the tubular rib knit structure comprises a cationic-dyeable polyethylene terephthalate yarn (known herein as a CD-PET yarn) that is yarn dyed. The yarn used to knit the second portion of the tubular rib knit structure comprises a polyamide yarn (commonly known as a nylon yarn) that is generally yarn dyed due to cost and the ability to obtain a uniform color across different yarn skeins but may be dope dyed. And the yarn used to knit the third portion of the tubular rib knit structure comprises a non-cationic dyeable polyethylene terephthalate yarn (known herein as a PET yarn) that is dope dyed.

With respect to using yarn selection to maintain the color integrity of the knit component, because the CD-PET yarns and the polyamide yarns are yarn dyed, they may be prone to color leaching when positioned or knit next to each other especially during, for instance, wash. By contrast, dope-dyed yarns generally resist color leaching due to the colorant being added to the polymer melt material during the spinning of the yarn (i.e., the colorant is an intrinsic property of the yarn strand). Thus, by positioning the dope-dyed PET yarn on the top side of the tubular rib knit structure, the dope dyed PET yarn can be used to separate the yarn-dyed CD-PET yarn and the yarn-dyed polyamide yarn on the first and second portions respectively of the tubular rib knit structure and prevent color leaching between the yarn-dyed CD-PET yarn and the yarn-dyed polyamide yarn during, for instance, wash and wear.

With respect to using yarn selection to produce the color-shifting properties of the knit component, after the knit component is knit, a dye substance may be applied to one or more areas of the knit component including the first area of the knit component but not the second area of the knit component. In example aspects, the dye substance comprises an acidic dye substance, and in further example aspects, the acidic dye substance comprises metallized content. Because the CD-PET yarn is yarn dyed as opposed to dope dyed, the acidic dye substance produces a discharge effect (i.e., a removal of color from the CD-PET yarn) in the first portion of the tubular rib knit structure causing the first portion of the tubular rib knit structure to change from a first color to a second color at the first area of the knit component. The addition of the metallized content to the acidic dye substance may cause a more pronounced discharge effect. Moreover, the acidic dye substance also causes the polyamide yarn to change from a third color to a fourth color at the first area of the knit component. More particularly, the acidic dye substance causes the polyamide yarn to be dyed to generally the same color of the acidic dye substance through, for instance, an additive dye process. The dope-dyed PET yarn is resistant to the acidic dye substance and, hence, does not change color during the dying process. As such, the dope-dyed PET yarn exhibits the same color at both the first area and the second area of the knit component.

Positional terms as used herein to describe articles of apparel incorporating the knit component such as "upper," "lower," "exterior surface," "interior surface,", "front," "back," and the like are with respect to the article of apparel being worn as intended and as shown and described herein by a wearer standing in anatomical position. Thus, the upper part of an article of apparel is positioned closer to a head area of a wearer, and the lower part of the article of apparel is positioned closer to a foot area of a wearer. The interior surface of an article of apparel is positioned to face inwardly (i.e., toward a body surface of a wearer), and the exterior surface of the article of apparel it positioned to face outwardly (i.e., away from a body surface of a wearer). The front of an article of apparel is configured to be positioned adjacent to a front torso area, a front arm area, and/or a front leg area of a wearer, and the back of the article of apparel is configured to be positioned adjacent to a back torso area, a back arm area, and/or a back leg area of a wearer.

The term "tubular rib knit structure" as used herein may mean a knitted non-planar tube, including a hollow tube that extends away from a surface of the knit component. The tubular rib knit structure may be formed by co-extensive and overlapping knit layers that are closed to form the tube. The term "integrally knit" as used herein may mean a knit component having a yarn from one or more knitted courses being interlooped with one or more knitted courses of another area. For instance, the tubular rib knit structure described herein may be integrally knit with a base portion of the knit component if a yarn from the tubular rib knit structure is interlooped with a yarn or knit course in the base portion. Or the different portions of the tubular rib knit structure are integrally knit with each other when a first yarn used to form the first portion of the tubular rib knit structure is interlooped with a third yarn used to form the third portion, and where the third yarn used to form the third portion is interlooped with a second yarn used to form the second portion of the tubular rib knit structure.

Moreover, the term "yarn" as used herein may mean an assemblage of fibers or filaments that are twisted or laid together so as to form a continuous strand that can be formed into, for instance, the knit component described herein. The term "yarn" may also encompass a single monofilament that forms a continuous strand. When describing, for instance, that the first portion, the second portion, and the third portion of a tubular rib knit structure are formed from a first yarn, a second yarn, and a third yarn respectively, it is contemplated herein that the term yarn may comprise two or more yarn strands of the same type that are joined end-to-end to form the respective first, second, and third portions of the tubular rib knit structures.

The yarns described herein may comprise different types where the different types may comprise different chemical compositions as is known in the textile art space. For instance, the yarn types may comprise CD-PET yarns, polyamide yarns, and PET yarns, where each of these types comprises a different chemical composition. For instance, CD-PET yarns may comprise PET yarns which have been modified during polymerization to generate anionic sites (e.g., sulfonic acid groups). Because the yarns comprise different chemical compositions, the yarns may react differently when exposed to various dye substances such as acidic dyes, basic dyes, disperse dyes, and the like.

As used herein, the term "yarn dyed" means a process where a color is added after the yarn has been manufactured and may encompass skein dying, package dyeing, beam dyeing, and the like. The degree of color penetration into the yarn may be variable depending on the thickness/denier of the yarns. The term "dope dyed" as used herein is the process of adding color to a polymer solution before it is extruded through a spinneret. Because it is added to the fibers/filaments as they are being formed, the color pigments are part of the fiber/filament which makes the fibers/filaments generally colorfast. The term "discharge effect" as used herein means the removal of some or all of a color or dye from a yarn. In practical terms, if a yarn is dyed, for instance, a dark blue color, the yarn may exhibit a light blue color after the dark blue color is discharged. That is, a yarn having a first color may exhibit a tint of the first color after the discharge effect occurs.

The term "visual effect" as used herein broadly means the visual impression created by different areas of the knit component. This may be due to different characteristic of the yarns used to form the tubular rib knit structures described herein including differences in texture, denier, shine, color, and the like. With respect to the term "color," the term generally relates to a color of a material that may be afforded by dyes and/or colorants. Moreover, the term "color" when describing, for example, a yarn means an observable color of fibers/filaments that form the yarn. Such aspects contemplate that a color may be any color that may be afforded to a yarn using dyes, pigments, and/or colorants that are known in the art. As such, a yarn may be configured to have a color including, but not limited to red, orange, yellow, green, blue, indigo, violet, white, black, and shades thereof.

Aspects related to a color further contemplate determining if one color is different from another color. In these aspects, a color may comprise a numerical color value, which may be determined by using instruments that objectively measure and/or calculate color values of a color of an object by standardizing and/or quantifying factors that may affect a perception of a color. Such instruments include, but are not limited to spectroradiometers, spectrophotometers, and the like. Thus, aspects herein contemplate that a "color" of a yarn, a portion of the yarn, or a portion of a tubular rib knit structure formed from the yarn may comprise a numerical color value that is measured and/or calculated using spectroradiometers and/or spectrophotometers. Moreover, numerical color values may be associated with a color space or color model, which is a specific organization of colors that provides color representations for numerical color values, and thus, each numerical color value corresponds to a singular color represented in the color space or color model.

In these aspects, a color may be determined to be different from another color if a numerical color value of each color differs. Such a determination may be made by measuring and/or calculating a numerical color value of, for instance, a portion of a tubular rib knit structure having a first color with a spectroradiometer or a spectrophotometer, measuring and/or calculating a numerical color value of a different portion of the tubular rib knit structure having a second color with the same instrument (i.e., if a spectrophotometer was used to measure the numerical color value of the first color, then a spectrophotometer is used to measure the numerical color value of the second color), and comparing the numerical color value of the first color with the numerical color value of the second color. If the numerical color values are not equal, then the first color is different than the second color, and vice versa.

Further, it is also contemplated that a visual distinction between two colors may correlate with a percentage difference between the numerical color values of the first color and the second color, and the visual distinction will be greater as the percentage difference between the color values increases. Moreover, a visual distinction may be based on a comparison between colors representations of the color values in a color space or model. For instance, when a first color has a numerical color value that corresponds to a represented color that is black or navy and a second color has a numerical color value that corresponds to a represented color that is red or yellow, a visual distinction between the first color and the second color is greater than a visual distinction between a first color with a represented color that is red and a second color with a represented color that is yellow.

An example knit component 100 is illustrated in FIG. 1. The knit component 100 comprises a first surface 105 and a second surface positioned opposite the first surface 105 (not seen in this view). The knit component 100 further comprises a plurality of tubular rib knit structures 110 and a plurality of base portions 112 that separate or space apart adjacent tubular rib knit structures 110. As will be described below, the tubular rib knit structures 110 may comprise integrally knit structures that extend away from the base portions 112 on the first surface 105 of the knit component 100. Further, the tubular rib knit structures 110 are integrally knit with the base portions 112. Although shown as a series of parallel, linear, evenly spaced structures, it is contemplated herein that the tubular rib knit structures 110 may assume other arrangements such as non-parallel structures, non-linear structures, non-evenly spaced structures, and the like. Further, although the base portions 112 are shown as visible between the tubular rib knit structures 110, it is contemplated herein that the tubular rib knit structures 110 may be spaced such that the base portions 112 are generally not visible (i.e., the tubular rib knit structures 110 may be tightly spaced). Any and all aspects, and any variation thereof, are contemplated as being within aspects herein.

FIG. 1 further illustrates a first area 114 of the knit component 100 and a second area 116 of the knit component 100 where tubular rib knit structures 118, 120, and 122 extend through both the first area 114 and the second area 116 of the knit component 100. The first area 114 is positioned at a different location on the knit component 100 compared to the second area 116. As will be described further below, the first area 114 may represent an area to which a dye substance has been applied to the knit component 100 which causes portions of the tubular rib knit structures 118, 120, and 122 to exhibit a different visual effect such as a different color. The depiction of the first area 114 and the second area 116 are illustrative only, and it is contemplated herein that the first area 114 and the second area 116 may comprise different shapes, sizes, arrangements, and patterns than those shown in FIG. 1. For instance, the first area 114 may comprise a line-like form that is linear, sinuous, sinusoidal, and the like. As well, the first area 114 may comprise a graphic, an image, a logo, other types of branding, geometric shapes, organic shapes, and the like. Any and all aspects, and any variation thereof, are contemplated as being within aspects herein.

Figure 2:
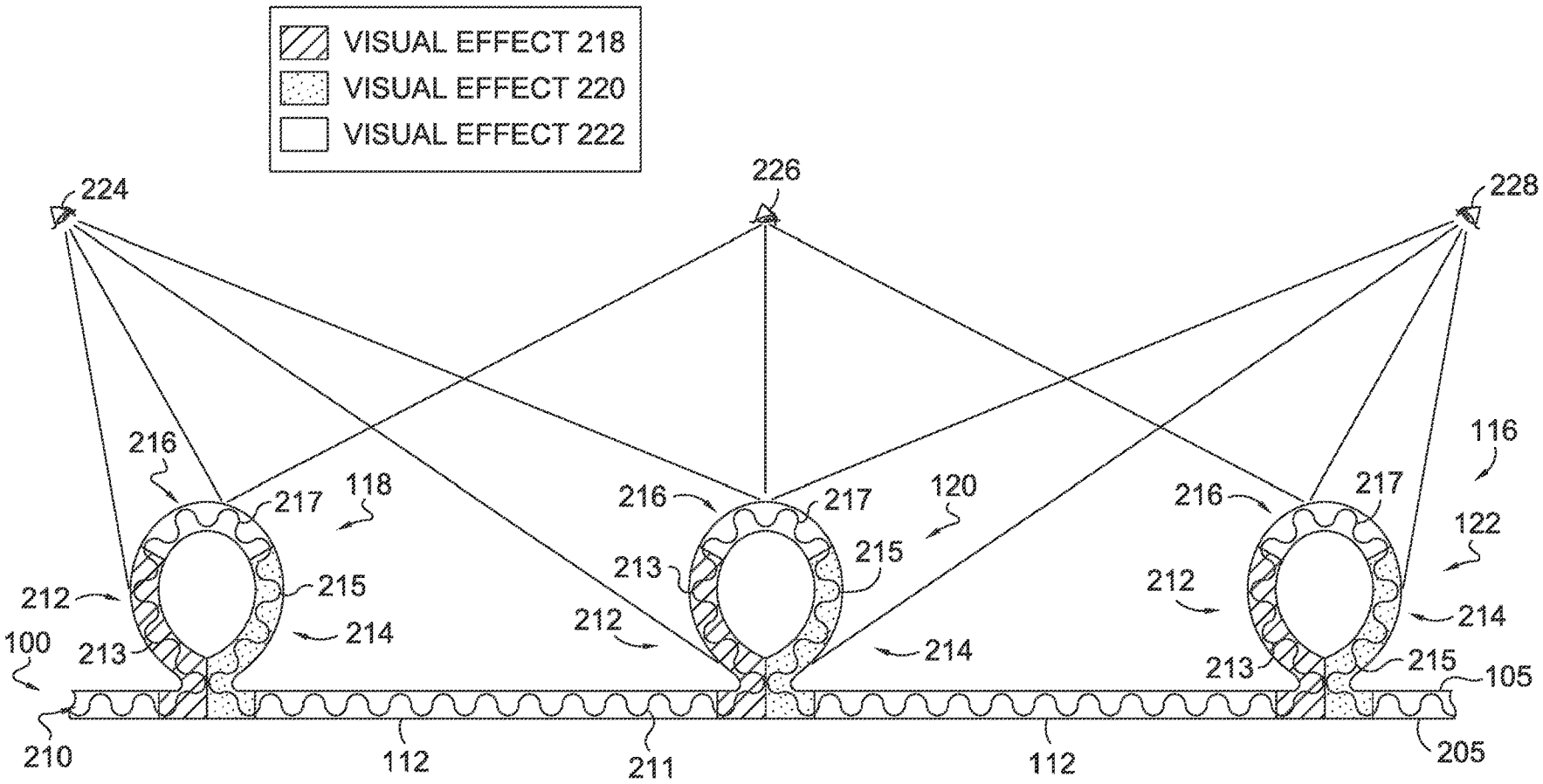
FIG. 2 illustrates a cross-sectional view taken along cut line 2-2 of FIG. 1 and depicts visual effects associated with the tubular rib knit structures in the second area of the knit component in accordance with aspects herein.

Turning to FIG. 2, a cross-section view of the tubular rib knit structures 118, 120, and 122 taken along cut line 2-2 in the second area 116 of the knit component 100 is illustrated in accordance with aspects herein. The tubular rib knit structures 118, 120, and 122 are shown extending from the base portion 112 on the first surface 105 of the knit component 100. The second opposite surface 205 of the knit component 100 is also depicted. In example aspects, the second surface 205 of the knit component 100 may comprise a generally planar surface without tubular rib knit structures, although it is contemplated herein that the second surface 205 may also comprise tubular rib knit structures. The integral knit characteristic of the knit component 100 is schematically illustrated by line 210 that extends through the base portions 112 and the tubular rib knit structures 118, 120, and 122, where the line 210 represents yarns used to form the knit component 100.

Each of the tubular rib knit structures 118, 120, and 122 comprises a first portion 212 positioned on a first longitudinal side of the structure, a second portion 214 positioned on a second longitudinal side of the structure opposite the first longitudinal side, and a third portion 216 positioned on a top side of the tubular rib knit structures 118, 120, and 122. In example aspects, the first portion 212 may be formed from a first yarn 213, the second portion 214 may be formed from a second yarn 215, and the third portion 216 may be formed from a third yarn 217. The first yarn 213, in example aspects, may comprise a CD-PET yarn, the second yarn 215 may comprise a polyamide yarn, and the third yarn 217 may comprise a PET yarn. The CD-PET yarn may comprise a yarn-dyed yarn, the polyamide yarn may comprise one of a yarn-dyed polyamide yarn or a dope-dyed polyamide yarn, and the PET yarn may comprise a dope-dyed PET yarn. It is further contemplated herein that that the base portions 112 of the knit component 100 may also be formed from a dope-dyed PET yarn.

Forming the third portion 216 of the tubular rib knit structures 118, 120, and 122 from a dope-dyed PET yarn facilitates the colorfastness of the knit component 100 especially when the polyamide yarn is yarn dyed. Because the color quality of a yarn-dyed yarn is not an intrinsic quality of the yarn as seen in dope-dyed yarns, the color of a yarn-dyed yarn may leach during wash and wear. By separating or spacing apart the yarn-dyed CD-PET yarn and the yarn-dyed polyamide yarn on the tubular rib knit structures 118, 120, and 122 using the dope-dyed PET yarn, color leaching between the yarn-dyed CD-PET yarn and the yarn-dyed polyamide yarn may be reduced or prevented because the yarn-dyed CD-PET yarn and the yarn-dyed polyamide yarn are not in contact with each other. Moreover, spacing apart adjacent tubular rib knit structures, such as the tubular rib knit structures 118, 120, and 122, using the base portions 112 comprising the dope-dyed PET yarn may further prevent color leaching between adjacent tubular rib knit structures and promote colorfastness.

The first portion 212 of the tubular rib knit structures 118, 120, and 122 may exhibit a visual effect 218 in the second area 116 (shown as positively sloped hatching and indicated in the key), and the second portion 214 of the tubular rib knit structures 118, 120, and 122 may exhibit a visual effect 220 in the second area 116 (shown as stippling and indicated in the key). The third portion 216 of the tubular rib knit structures 118, 120, and 122 may exhibit a visual effect 222 in the second area 116 (shown as an absence of shading and indicated in the key). As described above, the visual effects 218, 220, and 222 may comprise texture, shine, denier, and/or color. In one example aspects, the visual effects 218, 220, and 222 may comprise a color. In a further example aspect, the visual effect 218 may comprise a different color from the visual effect 220 and the visual effect 222, and the visual effect 220 may comprise a different color from the visual effect 222.

In example aspects, the visual effects 218, 220, and 222 may be visible when viewing the knit component 100 from one viewing angle but may not be visible when viewing the knit component 100 from a different viewing angle. FIG. 2 illustrates some example viewing angles 224, 226, and 228 for the second area 116 of the knit component 100. With respect to the viewing angle 224, which is from a first side of the knit component 100, the first portion 212 and the third portion 216 of the tubular rib knit structures 118, 120, and 122 may be visible, while the second portion 214 may not be visible. As such, when viewing the knit component 100 from the viewing angle 224, a viewer would see the visual effect 218 exhibited by the first portion 212 of the tubular rib knit structures 118, 120, and 122 and would see the visual effect 222 exhibited by the third portion 216 of the tubular rib knit structures 118, 120, and 122.

With respect to the viewing angle 228, which is from a second opposite side of the knit component 100, the second portion 214 and the third portion 216 of the tubular rib knit structures 118, 120, and 122 may be visible, while the first portion 212 may not be visible. As such, when viewing the knit component 100 from the viewing angle 228, a viewer would see the visual effect 220 exhibited by the second portion 214 of the tubular rib knit structures 118, 120, and 122 and would see the visual effect 222 exhibited by the third portion 216 of the tubular rib knit structures 118, 120, and 122. Regarding the viewing angle 226, which is from an angle generally perpendicular to the first surface 105 of the knit component 100, generally only the third portion 216 of the tubular rib knit structures 118, 120, and 122 may be visible, while the first portion 212 and the second portion 214 may not be visible. Accordingly, when viewing the knit component 100 from the viewing angle 226, a viewer would see the visual effect 222 exhibited by the third portion 216 of the tubular rib knit structures 118, 120, and 122.

Figure 3:
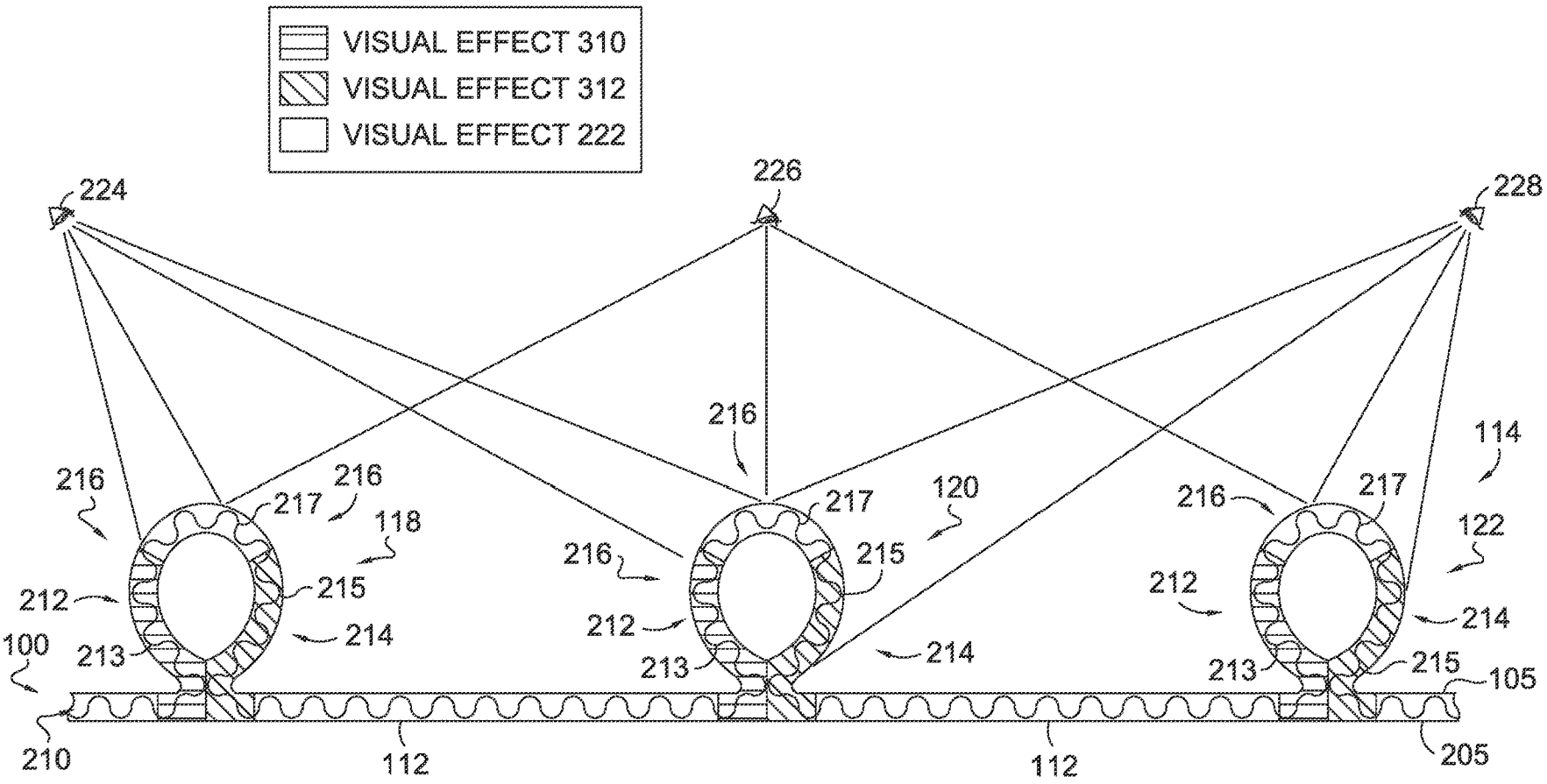
FIG. 3 illustrates a cross-sectional view taken along cut line 3-3 of FIG. 1 and depicts visual effects associated with the tubular rib knit structures of FIG. 1 in the first area of the knit component in accordance with aspects herein.

FIG. 3 depicts a cross-section view of the tubular rib knit structures 118, 120, and 122 taken along cut line 3-3 in the first area 114 of the knit component 100 in accordance with aspects herein. Similar to FIG. 2, the tubular rib knit structures 118, 120, and 122 are shown extending from the base portions 112 on the first surface 105 of the knit component 100. The integral knit characteristic of the knit component 100 is schematically illustrated by the line 210 that extends through the base portion 112 and the tubular rib knit structures 118, 120, and 122, where the line 210 represents yarns used to form the knit component 100. Moreover, the line 210 further indicates that the tubular rib knit structures 118, 120, and 122 integrally extend across the first area 114 and the second area 116. That is, the yarns used to knit the portion of the tubular rib knit structures 118, 120, and 122 in the first area 114 are also used to knit the portion of the tubular rib knit structures 118, 120, and 122 in the second area 116. To say this differently, in example aspects, there are no seam lines that disrupt the continuity of the tubular rib knit structures 118, 120, and 122 as they extend across the first area 114 and the second area 116.

As described with respect to FIG. 2, the first portion 212 of the tubular rib knit structures 118, 120, and 122 are formed from the first yarn 213 which, in example aspects, may comprise the CD-PET yarn. The second portion 214 of the tubular rib knit structures 118, 120, and 122 are formed from the second yarn 215 which comprises the polyamide yarn. And the third portion 216 of the tubular rib knit structures 118, 120, and 122 are formed from the third yarn 217 which comprises the PET yarn. The CD-PET yarn may comprise a yarn-dyed yarn, the polyamide yarn may comprise one of a yarn-dyed polyamide yarn or a dope-dyed polyamide yarn, and the PET yarn may comprise a dope-dyed PET yarn.

The first area 114 of the knit component 100 represents the area to which a dye substance has been applied. The dye substance causes the visual effect exhibited by the first portion 212 of the tubular rib knit structures 118, 120, and 122 to change from the visual effect 218 to a new visual effect 310 (shown as horizontally oriented lines and indicated in the key). Moreover, the dye substance may also cause the visual effect exhibited by the second portion 214 of the tubular rib knit structures 118, 120, and 122 to change from the visual effect 220 to a new visual effect 312 (shown as negatively sloped hatching and indicated in the key). The third portion 216 of the tubular rib knit structures 118, 120, and 122, however, may continue to exhibit the visual effect 222 in the first area 114. In other words, the dye substance may not cause a visual effect change in the third yarn 217 forming the third portion 216. As described above, the visual effects 310, 312, and 222 may comprise texture, shine, denier, and/or color. In one example aspect, the visual effects 310, 312, and 222 may comprise a color. Thus, for instance, the visual effect 310 of the first portion 212 of the tubular rib knit structures 118, 120, and 122 in the first area 114 may comprise a different color from the color associated with the visual effect 218 of the first portion 212 of the tubular rib knit structures 118, 120, and 122 in the second area 116. Similarly, the visual effect 312 of the second portion 214 of the tubular rib knit structures 118, 120, and 122 in the first area 114 may comprise a different color from the color associated with the visual effect 220 of the second portion 214 of the tubular rib knit structures 118, 120, and 122 in the second area 116. But the visual effect 222 of the third portion 216 of the tubular rib knit structures 118, 120, and 122 in the first area 114 may comprise the same color as the color associated with the visual effect 222 of the third portion 216 of the tubular rib knit structures 118, 120, and 122 in the second area 116.

In example aspects, the dye substance may comprise an acidic dye that optionally comprises metallized content. The dye substance, in example aspects, may cause a discharge effect in the yarn-dyed CD-PET yarn that forms the first portion 212 of the tubular rib knit structures 118, 120, and 122. Thus, the color associated with the visual effect 310 of the first portion 212 in the first area 114 may comprise a tint of the color associated with the visual effect 218 of the first portion 212 in the second area 116. With respect to the polyamide yarn that forms the second portion 214 of the tubular rib knit structures 118, 120, and 122, the acidic dye substance may dye the polyamide yarn the same color, or substantially the same color, as the color of the acidic dye substance. And with respect to the dope-dyed PET yarn that forms the third portion 216 of the tubular rib knit structures 118, 120, and 122 as well as the base portions 112 of the knit component 100, the acidic dye substance may not effect or cause a color change in the PET yarn. As is known in the art of dyeing, PET yarns typically are dyed using disperse dyes.

When viewing the knit component 100 from the viewing angle 224, a viewer would see the visual effect 310 exhibited by the first portion 212 of the tubular rib knit structures 118, 120, and 122 and would see the visual effect 222 exhibited by the third portion 216 of the tubular rib knit structures 118, 120, and 122. When viewing the knit component 100 from the viewing angle 228, a viewer would see the visual effect 312 exhibited by the second portion 214 of the tubular rib knit structures 118, 120, and 122 and would see the visual effect 222 exhibited by the third portion 216 of the tubular rib knit structures 118, 120, and 122. And when viewing the knit component 100 from the viewing angle 226, a viewer would see the visual effect 222 exhibited by the third portion 216 of the tubular rib knit structures 118, 120, and 122.

Figure 4:
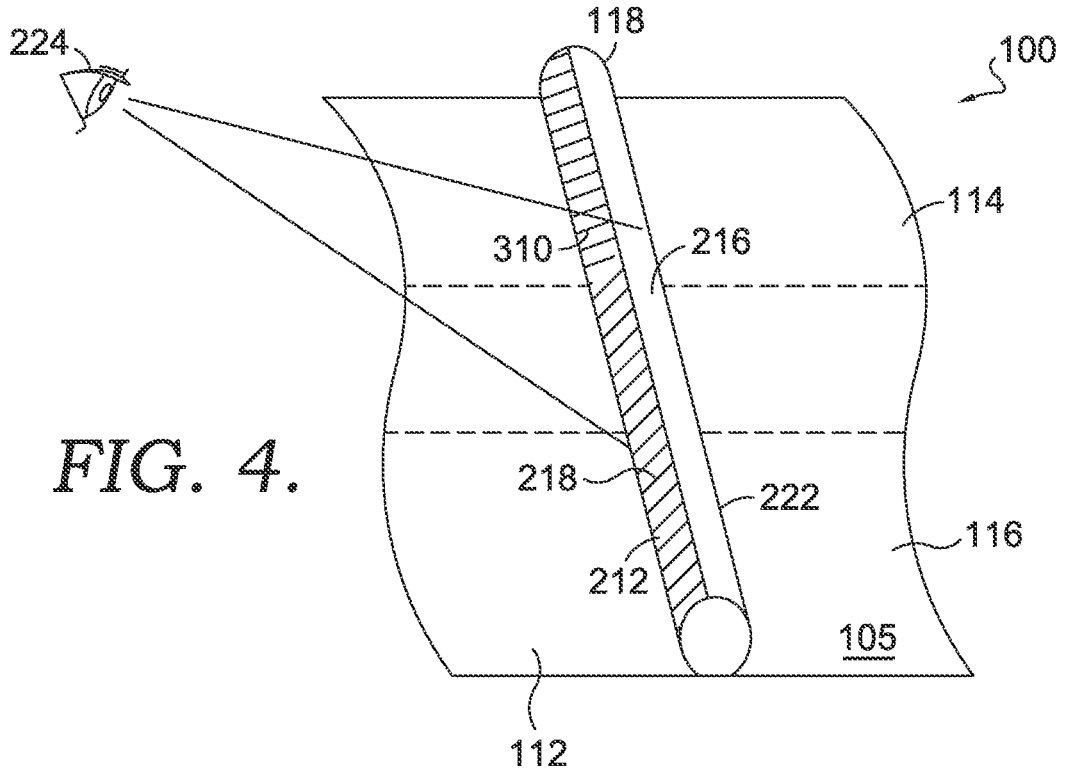
FIG. 4 illustrates a first-side perspective view taken along a length of a tubular rib knit structure that extends through the first area and the second area of the knit component of FIG. 1 in accordance with aspects herein.
Figure 5:
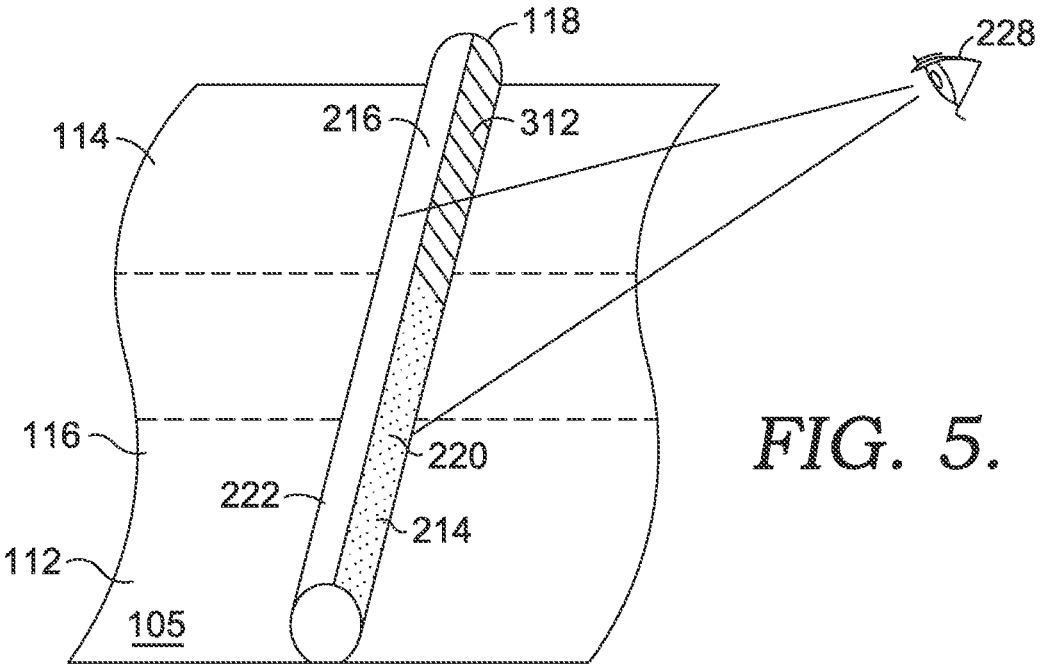
FIG. 5 illustrates a second-side perspective view taken along the length of the tubular rib knit structure of FIG. 4 in accordance with aspects herein.

Turning now to FIGS. 4 and 5, these figures illustrate perspective views taken along the length of an example tubular rib knit structure, such as the tubular rib knit structure 118, in accordance with aspects herein. The perspective view of FIG. 4 is taken from the viewing angle 224 of FIGS. 2 and 3, and the perspective view of FIG. 5 is taken from the viewing angle 228 of FIGS. 2 and 3. With respect to FIG. 4, the base portion 112 of the knit component 100 is shown along with the first portion 212 of the tubular rib knit structure 118 and some of the third portion 216 of the tubular rib knit structure 118. The tubular rib knit structure 118 projects away from the first surface 105 of the base portion 112 and is depicted as extending through the second area 116 and the first area 114 where the first area 114 is the area of the knit component 100 to which a dye substance is applied.

The first portion 212 of the tubular rib knit structure 118 changes from the visual effect 218 in the second area 116 to the visual effect 310 in the first area 114 of the knit component 100. Thus, when the first portion 212 of the tubular rib knit structure 118 is viewed from the viewing angle 224, a viewer would observe the two different visual effects 218 and 310 along the length of the tubular rib knit structure 118. When the visual effects 218 and 310 comprise colors, a viewer would observe a first color for the first portion 212 in the first area 114 of the tubular rib knit structure 118 and a second color for the first portion 212 in the second area 116 of the tubular rib knit structure 118. As further shown in FIG. 4, when the third portion 216 of the tubular rib knit structure 118 is viewed from the viewing angle 224, a viewer would observe the same visual effect 222 in both the first area 114 and the second area 116. When the visual effect 222 comprises a color, a viewer would observe the same color for the third portion 216 in both the first area 114 and the second area 116.

With respect to FIG. 5, the base portion 112 of the knit component 100 is shown along with the second portion 214 of the tubular rib knit structure 118 and some of the third portion 216 of the tubular rib knit structure 118. The second portion 214 of the tubular rib knit structure 118 changes from the visual effect 220 in the second area 116 to the visual effect 312 in the first area 114 of the knit component 100. Thus, when the second portion 214 of the tubular rib knit structure 118 is viewed from the viewing angle 228, a viewer would observe the two different visual effects 220 and 312 along the length of the tubular rib knit structure 118. When the visual effects 220 and 312 comprise colors, a viewer would observe a first color for the second portion 214 in the first area 114 of the tubular rib knit structure 118 and a second color for the second portion 214 in the second area 116 of the tubular rib knit structure 118. As further shown in FIG. 5, when the third portion 216 of the tubular rib knit structure 118 is viewed from the viewing angle 228, a viewer would observe the same visual effect 222 in both the first area 114 and the second area 116. When the visual effect 222 comprises a color, a viewer would observe the same color for the third portion 216 in both the first area 114 and the second area 116.

Figure 7:
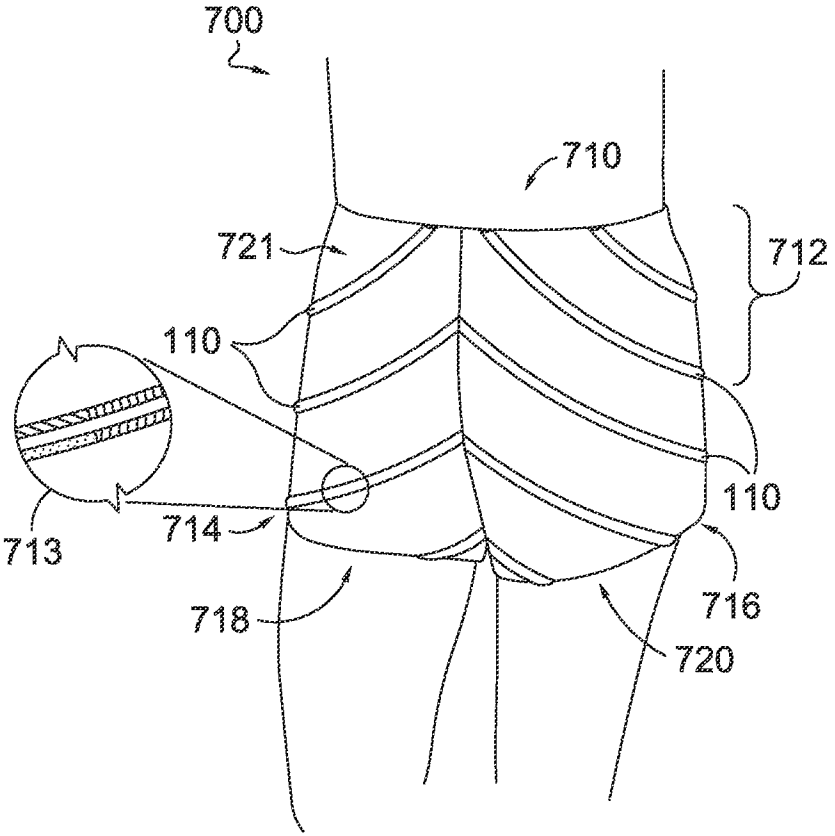
FIG. 7 illustrates a front perspective view of an example lower-body garment formed, at least in part, from the knit component of FIG. 1 being worn by a wearer in accordance with aspects herein.
Figure 6:
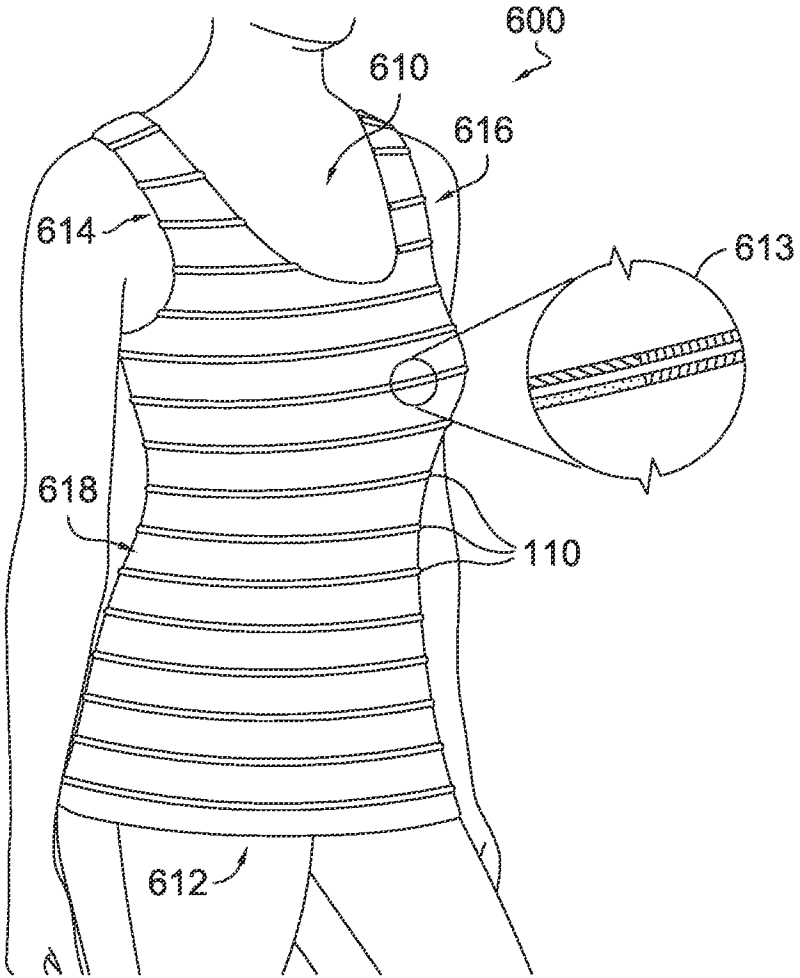
FIG. 6 illustrates a front perspective view of an example upper-body garment formed, at least in part, from the knit component of FIG. 1 being worn by a wearer in accordance with aspects herein.
Figure 8:
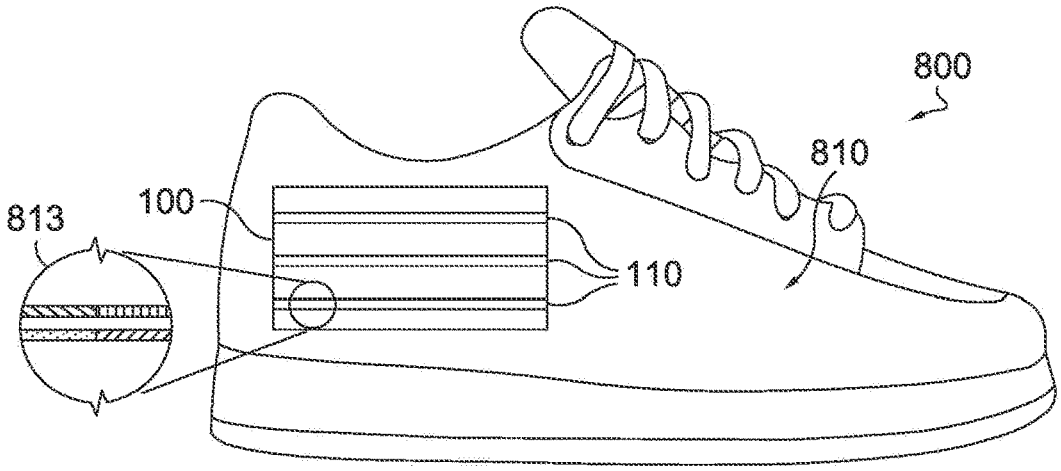
FIG. 8 illustrates an example shoe formed, at least in part, from the knit component of FIG. 1 in accordance with aspects herein.

Turning to FIGS. 6-8, depictions of different articles of apparel incorporating the knit component 100 are provided in accordance with aspects herein. FIG. 6 depicts an upper-body garment 600 in the form of a support garment such as a bra or camisole in accordance with aspects herein. When in the form of a support garment, it is contemplated herein that the upper-body garment 600 may include elastomeric yarns to provide compression as well as stretch and recovery characteristics to the upper-body garment 600. Although depicted as a support-type garment, it is contemplated herein that the upper-body garment 600 may comprise other types of upper-body garments such as a shirt, a jacket, a hoodie, a pullover, a vest, a tank, and the like. The upper-body garment 600 may comprise a neck opening 610, a waist opening 612, a first arm opening 614 and a second arm opening 616. The upper-body garment 600 comprises a front aspect 618 and a back aspect (not seen in FIG. 6).

In example aspects, some or all of the upper-body garment 600 may be formed from the knit component 100. The knit component 100 may be oriented on the upper-body garment 600 such that the tubular rib knit structures 110 are positioned in a particular orientation on the upper-body garment 600. As shown in FIG. 6, the tubular rib knit structures 110 are positioned in a generally horizontal orientation such that the extend from a first lateral side of the upper-body garment 600 to a second lateral side of the upper-body garment 600. However, this is just an example, and other orientations may include a vertical orientation of the tubular rib knit structures 110 or a diagonal orientation of the tubular rib knit structures 110. Further, the tubular rib knit structures 110 may be positioned in multiple different orientations (e.g., vertical, horizontal, and diagonal) on the upper-body garment 600. As shown by the magnified view 613, the tubular rib knit structures 110 may comprise the different visual effects 218, 220, 222, 310, and 312 of FIGS. 2-5 along their respective lengths. In aspects, the orientation of the tubular rib knit structures on the upper-body garment 600 may be selected to produce a level of distraction or visual interest in a viewer viewing the upper-body garment 600.

FIG. 7 depicts a lower-body garment 700 formed from the knit component 100, where the lower-body garment 700 is in the form of a short in accordance with aspects herein. Although shown as a short, it is contemplated herein that the lower-body garment 700 may be in the form of a pant, a capri, a tight, and the like. It is further contemplated herein that the knit component 100 used to form the lower-body garment 700 may include elastomeric yarns used to provide stretch and recovery characteristics to the lower-body garment 700. The lower-body garment 700 is shown as having a torso portion 712, a first leg portion 714, a second leg portion 716, a waist opening 710, a first leg opening 718, and a second leg opening 720. The lower-body garment 700 further includes a front aspect 721 and a back aspect (not seen in FIG. 7).

As described above, the tubular rib knit structure 110 may be positioned on the lower-body garment 700 in a number of different orientations. For instance, as shown in FIG. 7, the tubular rib knit structures 110 are positioned in a diagonal orientation. As shown by the magnified view 713, the tubular rib knit structures 110 may comprise the different visual effects 218, 220, 222, 310, and 312 of FIGS. 2-5 along their respective lengths. Similar to the upper-body garment 600, the orientation of the tubular rib knit structure 110 may be selected to produce a level of visual interest and/or distraction in a viewer viewing the lower-body garment 700.

The knit component 100 may also be used to form a component of a shoe such as a shoe upper as shown in FIG. 8. FIG. 8 depicts a shoe 800 having a shoe upper 810. The shoe upper 810 may comprise one or more portions formed from the knit component 100. Although the knit component 100 is shown at the midfoot area of the shoe 800, it is contemplated herein that the knit component 100 may be positioned at other locations on the shoe upper 810 or may form an entirety of the shoe upper 810. Similar to above, the knit component 100 may be positioned on the shoe 800 such that the tubular rib knit structures 110 assume a variety of orientations (e.g., horizontal, vertical, diagonal, and the like). As shown by the magnified view 813, the tubular rib knit structures 110 may comprise the different visual effects 218, 220, 222, 310, and 312 of FIGS. 2-5 along their respective lengths. And the selection of the particular orientation may be based on producing a level of visual interest and/or distraction in a viewer viewing the shoe 800.

The articles described in relation to FIGS. 6-8 are illustrative only, and it is contemplated herein that the knit component 100 may be incorporated in any number of articles such as bags, backpacks, duffel bags, hats, socks, and the like. Any and all aspects, and any variation thereof, are contemplated as being within aspects herein.

Figure 9:
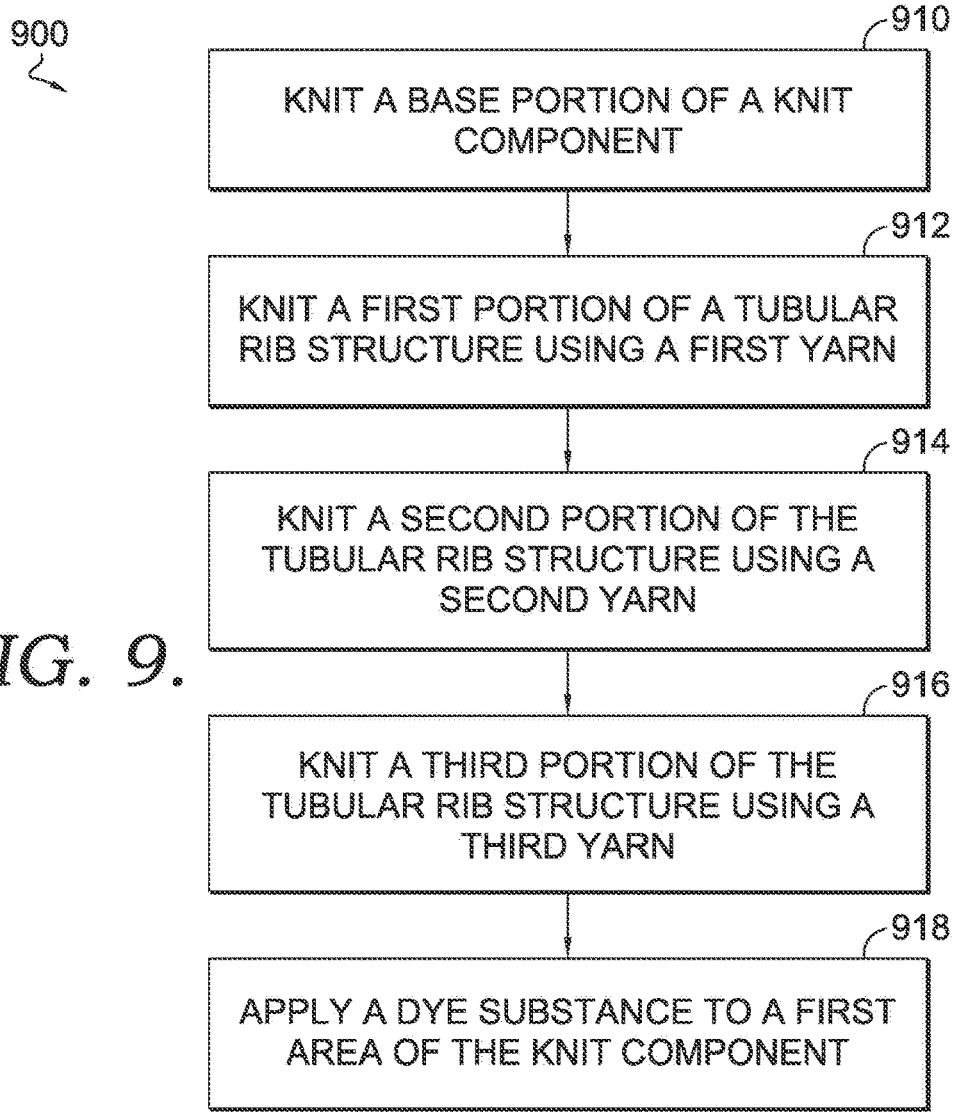
FIG. 9 illustrates a flow diagram of an example method of forming the knit component of FIG. 1 in accordance with aspects herein.

Turning to FIG. 9, a flow diagram of an example method 900 of knitting and dyeing a knit component, such as the knit component 100, is provided in accordance with aspects herein. The knitting may be carried out, for instance, on a weft knit machine, specifically a two-bed (V-bed) weft knit machine but it is contemplated herein that the knit component may be formed on other knit machines such as a circular knit machine or a warp knit machine. At a step 910, a base portion, such as the base portion 112, of the knit component is knit. In example aspects, the base portion may be knit using a PET yarn. More specifically, the base portion may be knit using a dope-dyed PET yarn.

At a step 912, a first portion of a tubular rib knit structure, such as the first portion 212 of the tubular rib knit structure 118, is knit. In example aspects, the first portion may be knit using a first yarn such as a CD-PET yarn. More specifically, the first portion may be knit using a yarn-dyed CD-PET yarn. At a step 914, a second portion of the tubular rib knit structure, such as the second portion 214 of the tubular rib knit structure 118 is knit using a second yarn. In example aspects, the second portion may be knit using a polyamide yarn. More specifically, the second portion may be knit using a yarn-dyed or a dope-dyed polyamide yarn. And at a step 916, a third portion of the tubular rib knit structure, such as the third portion 216 of the tubular rib knit structure 118 is knit using a third yarn. The third yarn may comprise a PET yarn. More specifically, the third yarn may comprise a dope-dyed PET yarn. The order of the steps 912, 914, and 916 is variable. For instance, the first portion may be knit, then the third portion may be knit, and then the second portion may be knit. Or the second portion may be knit, then the third portion may be knit, and then the first portion may be knit. Any and all aspects, and any variation thereof, are contemplated as being within aspects herein.

With further respect to the method 900, at a step 918, a dye substance is applied to a first area, such as the first area 114, of the knit component. In one example aspect, the dye substance may comprise an acidic dye substance as is known in the art of dyeing that is applied using techniques such as screen printing (either manual or flat-bed screen printing), manual application, digital printing, and the like. In example aspects, where screen printing is used, a mesh count of 80 may produce a more pronounced discharge effect in the yarn-dyed CD-PET yarns. The dye substance may be applied in a particular pattern including graphics, logos, branding, organic shapes, geometric shapes, and any combination thereof. Further, in example aspects, the dye substance may comprise metallized content where the metallized content may include $Mg^{+2}$, $Mn^{+2}$, $Cu^{+1}$, $Cu^{+2}$, and/or $Zn^{+2}$. In some aspects, the addition of metallized content causes a more pronounced discharge effect in the yarn-dyed CD-PET yarns. As well, in some aspects, a more acidic dye substance (e.g., 3% versus 2%) may produce a more pronounced discharge effect.

The method 900 may further comprise steaming the knit component after the acidic dye substance has been applied. In one example aspect, the steaming may occur at about 110-120 degrees Celsius for about 25-20 minutes although other temperatures and times are contemplated herein. The method 900 may additionally comprise washing the knit component before forming the knit component into an article of apparel.

It is contemplated herein that additional dyeing steps may occur. For example, in one example aspect, a disperse dye substance may first be applied to the knit component in a first pattern, and the knit component then may be steamed (e.g., steamed at about 120-130 degrees Celsius for 20-25 minutes) and washed. After washing, the acidic dyestuff (with or without metallized content) may then be applied to the knit component in a second pattern before the knit component is again steamed (e.g., steamed at about 110-120 degrees Celsius for 25-30 minutes) and washed. In areas of the knit component to which the disperse dye substance is applied, the disperse dye substance may cause the dope-dyed PET yarns and the yarn-dyed or dope-dyed polyamide yarns to change color. For instance, the dope-dyed PET yarns and the yarn-dyed or dope-dyed polyamide yarns may assume the same color or substantially the same color as the disperse dye substance. And as described above, in areas of the knit component to which the acidic dye substance (with or without metallized content) is applied, the acidic dye substance may cause a discharge effect in the yarn-dyed CD-PET yarns and may also cause the polyamide yarns to change color to, for instance, the same color or substantially the same color as the acidic dye substance. In areas of the knit component to which both the disperse dye substance and the acidic dye substance are applied, there is no discharge effect in the yarn-dyed CD-PET yarns and the dope-dyed PET yarns may assume the same color or substantially the same color as the disperse dye substance. With respect to the yarn-dyed or dope-dyed polyamide yarns, the polyamide yarns may assume the same color or substantially the same color as both the disperse dye substance and the acidic dye substance. In instances where the disperse dye substance and the acidic dye substance comprise a different color, the color of the polyamide yarn may comprise a combination of the two colors.

Thus with respect to the example tubular rib knit structure 118, the first portion 212 may still exhibit the visual effect 218 at one or more areas of the first portion 212 corresponding to where no dye substance was applied, where just the disperse dye substance was applied, and/or where both the acidic dye substance and the disperse dye substance were applied. And the first portion 212 may exhibit the visual effect 310 at one or more different areas of the first portion 212 corresponding to where the acidic dye substance (with or without metallized content) was applied.

Continuing, the second portion 214 of the example tubular rib knit structure 118 may still exhibit the visual effect 220 at one or more areas of the second portion 214 corresponding to where no dye substance was applied. The second portion 214 may exhibit the visual effect 312 at one or more areas of the second portion 214 corresponding to where the acidic dye substance was applied. And the second portion 214 may exhibit yet another different visual effect (i.e., a visual effect different from the visual effect 220 and the visual effect 312) at one or more areas of the second portion 214 corresponding to where the disperse dye substance was applied.

The third portion 216 of the example tubular rib knit structure 118 may continue to exhibit the visual effect 222 at one or more areas of the third portion 216 corresponding to where the no dye substance was applied or to where the acidic dye substance was applied. However, the third portion 216 may exhibit a different visual effect (i.e., a visual effect different from the visual effect 222) at one or more areas of the third portion 216 corresponding to where the disperse dye substance was applied. Any and all aspects, and any variation thereof, are contemplated as being within aspects herein.

Figure 10:
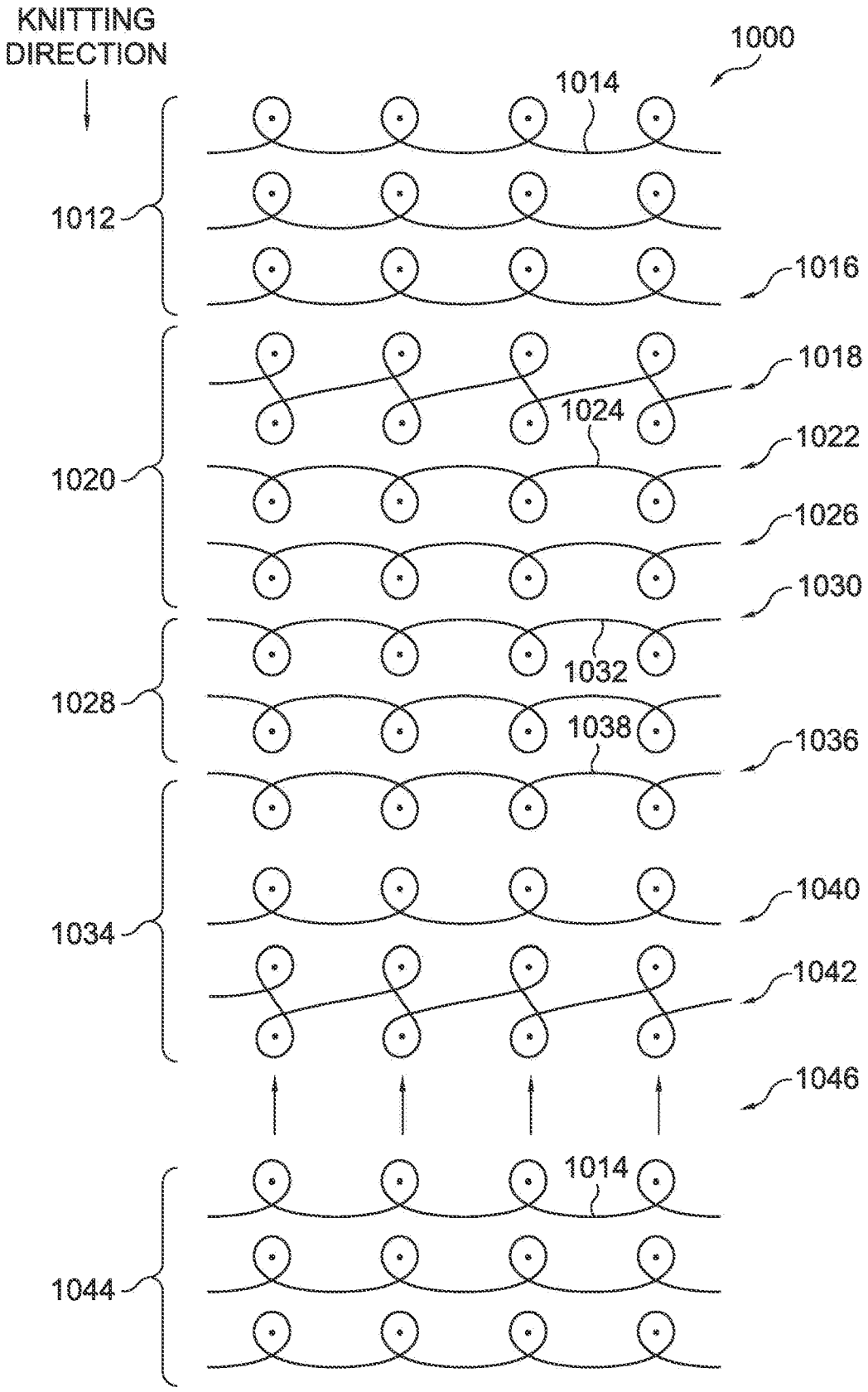
FIG. 10 illustrates a schematic knitting diagram for knitting the tubular rib knit structures described herein in accordance with aspects herein.

Turning now to FIG. 10, a knitting diagram 1000 is provided to illustrate one example way of knitting a knit component, such as the knit component 100, in accordance with aspects herein. A base portion 1012, such as the base portion 112, may be formed from a yarn 1014 (e.g., a dope-dyed PET yarn) using a rear needle bed of, for instance, a two-bed weft knit machine. After knitting a final course 1016 of the base portion 1012 using the yarn 1014, a linking course 1018 may be formed extending between the rear needle bed and a front needle bed of the two-bed weft knit machine.

Next, one or more courses may be knit on the front needle bed. For instance, courses forming a first portion 1020, such as the first portion 212 of the example tubular rib knit structure 118, can be formed in a similar manner as course 1022 knit using a yarn 1024 (e.g., a yarn-dyed CD-PET yarn) on the front needle bed. Next, after a final course 1026 of the first portion 1020 is knit on the front needle bed using the yarn 1024, courses forming a third portion 1028, such as the third portion 216 of the example tubular rib knit structure 118, can be formed in a similar manner as course 1030 using a yarn 1032 (e.g., a dope-dyed PET yarn).

After the desired number of courses forming the third portion 1028 are knit using the yarn 1032, additional courses forming a second portion 1034, such as the second portion 214 of the example tubular rib knit structure 118, can be formed in a similar manner as course 1036 using a yarn 1038 (e.g., a yarn-dyed or dope-dyed polyamide yarn) on the front needle bed. After the desired number of courses forming the second portion 1034 are knit on the front needle bed, the yarn 1038 may be used to knit a course 1040 with the rear needle bed. For example, the course 1040 may form the last course of the second portion 1034 of the tubular rib knit structure that closes the tubular rib knit structure and forms a hollow tunnel. After the course 1040 finishes the tubular rib knit structure, another linking course 1042 may be formed extending between the rear needle bed and the front needle bed that is interlooped to the previous courses on the front needle bed and the rear needle bed. By using a knit stitch at the linking course 1042 that extends between the rear needle bed and the front needle bed, the yarn 1038 forming the second portion 1034 of the tubular rib knit structure can be prepared to be associated with additional courses forming another base portion 1044 with the yarn 1014 using the rear needle bed by transferring the knit component to the rear needle bed at step 1046 and repeating the process described above until the knitted component is completed.

In various aspects, different numbers of courses may be knit on one or both of the front needle bed and rear needle bed so as to change the shape and/or size of the tubular rib knit structures. In one illustrative example, four courses may be used to form the base portion 1012, four courses may be used to form the first portion 1020, eight courses may be used to form the third portion 1028, and four courses may be used to form the second portion 1034.

The following clauses represent example aspects of concepts contemplated herein. Any one of the following clauses may be combined in a multiple dependent manner to depend from one or more other clauses. Further, any combination of dependent clauses (clauses that explicitly depend from a previous clause) may be combined while staying within the scope of aspects contemplated herein. The following clauses are examples and are not limiting.

Clause 1. A knit component comprising:

a tubular rib knit structure that extends across a first area and a second area of the knit component, the tubular rib knit structure comprising a first portion and a second portion positioned on opposing sides of the tubular rib knit structure; and a base portion disposed adjacent to the tubular rib knit structure, wherein:

the tubular rib knit structure extends away from the base portion on a first surface of the knit component, the first portion of the tubular rib knit structure exhibits a first visual effect at the first area of the knit component, the first portion of the tubular rib knit structure exhibits a second visual effect at the second area of the knit component, the second portion of the tubular rib knit structure exhibits a third visual effect at the first area of the knit component, and the second portion of the tubular rib knit structure exhibits a fourth visual effect at the second area of the knit component.

Clause 2. The knit component according to clause 1, wherein the first visual effect comprises a first color, and wherein the second visual effect comprises a second color different from the first color.

Clause 3. The knit component according to any of clauses 1 through 2, wherein the third visual effect comprises a third color, and the fourth visual effect comprises a fourth color different from the third color.

Clause 4. The knit component according to clause 3, wherein the third color and the fourth color are different from the first color and the second color.

Clause 5. The knit component according to any of clauses 1 through 4, the tubular rib knit structure further comprising a third portion positioned between the first portion and the second portion on a top side of the tubular rib knit structure.

Clause 6. The knit component according to clause 5, wherein the third portion exhibits a fifth visual effect at both the first area and the second area of the knit component.

Clause 7. The knit component according to any of clauses 5 through 6, wherein:

the first portion of the tubular rib knit structure is formed from a first yarn, the second portion of the tubular rib knit structure is formed from a second yarn different from the first yarn, and the third portion of the tubular rib knit structure is formed from a third yarn different from the first yarn and different from the second yarn.

Clause 8. The knit component according to clause 7, wherein:

the first yarn comprises a cationic-dyeable polyethylene terephthalate (CD PET) yarn, the second yarn comprises a polyamide yarn, and the third yarn comprises a polyethylene terephthalate (PET) yarn.

Clause 9. The knit component according to clause 8, wherein:

the CD-PET yarn is yarn dyed, the polyamide yarn is one of yarn dyed or dope dyed, and the PET yarn is dope dyed.

Clause 10. The knit component according to any of clauses 1 through 9, wherein the tubular rib knit structure integrally extends across the first area and the second area of the knit component.

Clause 11. A knit component comprising:

a tubular rib knit structure comprising:

a first portion formed using a cationic-dyeable polyethylene terephthalate (CD-PET) yarn, and a second portion formed using a polyamide yarn, the first portion and the second portion positioned on opposing sides of the tubular rib knit structure; and a base portion positioned adjacent to the tubular rib knit structure, wherein:

the tubular rib knit structure extends away from the base portion on a first surface of the knit component, the CD-PET yarn exhibits a first visual effect at a first area of the knit component, and the CD-PET yarn exhibits a second visual effect at a second area of the knit component.

Clause 12. The knit component according to clause 11, wherein the polyamide yarn exhibits a third visual effect at the first area of the knit component.

Clause 13. The knit component according to any of clauses 11 through 12, wherein the polyamide yarn exhibits a fourth visual effect at the second area of the knit component.

Clause 14. The knit component according to clause 13, wherein at least the first visual effect, the second visual effect, the third visual effect, and the fourth visual effect comprise different colors.

Clause 15. The knit component according to any of clauses 11 through 14, the tubular rib knit structure further comprising a third portion formed using a polyethylene terephthalate (PET) yarn, the third portion positioned between the first portion and the second portion on a top side of the tubular rib knit structure, wherein the PET yarn exhibits a fifth visual effect at both the first area and the second area of the knit component.

Clause 16. The knit component according to clause 15, wherein:

the CD-PET yarn is yarn dyed, the polyamide yarn is one of yarn dyed or dope dyed, and the PET yarn is dope dyed.

Clause 17. A method of manufacturing a knit component comprising:

knitting a first portion of a tubular rib knit structure using a first yarn;

knitting a second portion of the tubular rib knit structure using a second yarn;

knitting a third portion of the tubular rib knit structure using a third yarn, wherein the first portion and the second portion are positioned on opposing sides of the tubular rib knit structure, and wherein the third portion is positioned between the first portion and the second portion on a top side of the tubular rib knit structure;

knitting a base portion of the knit component, wherein the tubular rib knit structure extends away from the base portion on a first surface of the knit component; and applying a dye substance to a first area of the knit component, wherein subsequent to applying the dye substance to the first area of the knit component:

the first yarn exhibits a first visual effect at the first area, the first yarn exhibits a second visual effect at a second area of the knit component, and the third yarn exhibits a third visual effect at both the first area and the second area of the knit component.

Clause 18. The method of manufacturing the knit component according to clause 17, wherein:

the first yarn comprises a cationic-dyeable polyethylene terephthalate (CD-PET) yarn, the second yarn comprises a polyamide yarn, and the third yarn comprises a polyethylene terephthalate (PET) yarn.

Clause 19. The method of manufacturing the knit component according to clause 18, wherein:

the CD-PET yarn is yarn dyed, the polyamide yarn is one of dope dyed or yarn dyed, and the PET yarn is dope dyed.

Clause 20. The method of manufacturing the knit component according to any of clauses 17 through 19, wherein the second portion of the tubular rib knit structure exhibits a fourth visual effect at the first area of the knit component, and wherein the second portion of the tubular rib knit structure exhibits a fifth visual effect at the second area of the knit component.

Clause 21. The method of manufacturing the knit component according to clause 20, wherein the first visual effect, the second visual effect, the third visual effect, the fourth visual effect, and the fifth visual effect comprise different colors.

Clause 22. The method of manufacturing the knit component according to any of clauses 17 through 21, wherein the dye substance comprises an acidic dye stuff.

Clause 23. The method of manufacturing the knit component according to clause 22, wherein the acidic dye stuff includes metallized content.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described.

What is claimed is:

1. A method of manufacturing a knit component comprising:

knitting a first portion of a tubular rib knit structure using a first yarn;

knitting a second portion of the tubular rib knit structure using a second yarn;

knitting a third portion of the tubular rib knit structure using a third yarn; and applying a dye substance to a first area of the knit component, wherein subsequent to applying the dye substance to the first area of the knit component:

the first yarn exhibits a first visual effect at the first area, the first yarn exhibits a second visual effect at a second area of the knit component, and the third yarn exhibits a third visual effect at both the first area and the second area of the knit component.

2. The method of manufacturing the knit component of claim 1, wherein:

the first yarn comprises a cationic-dyeable polyethylene terephthalate (CD-PET) yarn, the second yarn comprises a polyamide yarn, and the third yarn comprises a polyethylene terephthalate (PET) yarn.

3. The method of manufacturing the knit component of claim 2, wherein the PET yarn is dope dyed.

4. The method of manufacturing the knit component of claim 1, wherein the second portion of the tubular rib knit structure exhibits a fourth visual effect at the first area of the knit component, and wherein the second portion of the tubular rib knit structure exhibits a fifth visual effect at the second area of the knit component.

5. The method of manufacturing the knit component of claim 1, wherein the first portion and the second portion are positioned on opposing sides of the tubular rib knit structure.

6. The method of manufacturing the knit component of claim 5, wherein the third portion is positioned between the first portion and the second portion on a top side of the tubular rib knit structure.

7. The method of manufacturing the knit component of claim 1, the method further comprising:

knitting a base portion of the knit component, wherein the tubular rib knit structure extends away from the base portion on a surface of the knit component.

8. A method of manufacturing a knit component comprising:

knitting a first portion of a tubular rib knit structure using a cationic-dyeable polyethylene terephthalate (CD-PET) yarn;

knitting a second portion of the tubular rib knit structure using a polyamide yarn; and knitting a third portion of the tubular rib knit structure using a polyethylene terephthalate (PET) yarn.

9. The method of manufacturing the knit component of claim 8, wherein the third portion is positioned between the first portion and the second portion on the tubular rib knit structure.

10. The method of manufacturing the knit component of claim 9, wherein the PET yarn is dope dyed.

11. The method of manufacturing the knit component of claim 9, wherein the first portion and the second portion are positioned on opposite sides of the tubular rib knit structure.

12. The method of manufacturing the knit component of claim 8, wherein the method further comprises:

applying an acidic dye substance to the knit component.

13. The method of manufacturing the knit component of claim 8, wherein the method further comprises:

applying a dye substance comprising metallized content to a first area of the knit component.

14. The method of manufacturing the knit component of claim 13, wherein subsequent to applying the dye substance to the first area of the knit component:

the CD-PET yarn exhibits a first visual effect at the first area, the CD-PET yarn exhibits a second visual effect at a second area of the knit component, the polyamide yarn exhibits a third visual effect at the first area of the knit component, the polyamide yarn exhibits a fourth visual effect at the second area of the knit component, and the PET yarn exhibits a fifth visual effect at both the first area and the second area of the knit component.

15. The method of manufacturing the knit component of claim 8, wherein the method further comprises:

knitting a base portion of the knit component, wherein the tubular rib knit structure extends away from the base portion on a surface of the knit component.

16. A method of manufacturing a knit component comprising:

knitting a first portion of a tubular rib knit structure using a first yarn;

knitting a second portion of the tubular rib knit structure using a second yarn; and knitting a third portion of the tubular rib knit structure using a third yarn, wherein the third portion is positioned between the first portion and the second portion on the tubular rib knit structure, and wherein the third yarn is dope dyed.

17. The method of manufacturing the knit component of claim 16, wherein the first portion and the second portion are positioned on opposite sides of the tubular rib knit structure.

18. The method of manufacturing the knit component of claim 17, wherein the third portion is positioned on a top side of the tubular rib knit structure.

19. The method of manufacturing the knit component of claim 16, wherein:

the first yarn comprises a cationic-dyeable polyethylene terephthalate (CD-PET) yarn, the second yarn comprises a polyamide yarn, and the third yarn comprises a polyethylene terephthalate (PET) yarn.

20. The method of manufacturing the knit component of claim 16, wherein the method further comprises:

applying, to the knit component, an acidic dye substance comprising metallized content.

* * * * *